US010415780B2

(12) United States Patent
Van Bommel et al.

(10) Patent No.: US 10,415,780 B2
(45) Date of Patent: Sep. 17, 2019

(54) LASER BASED LIGHTING SYSTEM AND METHOD

(71) Applicant: KONINKLIJKE PHILIPS N.V., Eindhoven (NL)

(72) Inventors: Ties Van Bommel, Aachen (DE); Rifat Ata Mustafa Hikmet, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/529,236

(22) PCT Filed: Nov. 20, 2015

(86) PCT No.: PCT/EP2015/077235
§ 371 (c)(1),
(2) Date: May 24, 2017

(87) PCT Pub. No.: WO2016/087235
PCT Pub. Date: Jun. 9, 2016

(65) Prior Publication Data

US 2017/0356613 A1 Dec. 14, 2017

(30) Foreign Application Priority Data

Dec. 2, 2014 (EP) ..... 14195824

(51) Int. Cl.
*F21V 11/00* (2015.01)
*F21S 41/14* (2018.01)
(Continued)

(52) U.S. Cl.
CPC ..... *F21S 41/14* (2018.01); *F21S 41/16* (2018.01); *F21S 41/40* (2018.01);
(Continued)

(58) Field of Classification Search
CPC ..... F21V 9/38; F21V 9/40; F21V 9/45; F21V 9/30; F21S 41/141
See application file for complete search history.

(56) References Cited

U.S. PATENT DOCUMENTS 6,350,041 B1 2/2002 Tarsa et al.
8,256,941 B2 9/2012 Hikmet et al.
(Continued)

OTHER PUBLICATIONS

Communication pursuant to Article 94(3) EPC dated Jun. 20, 2018, European Patent Application No. 15798082, 5 pages.
(Continued)

*Primary Examiner* — Matthew J. Peerce

(57) ABSTRACT

A laser lighting system has a first laser light source, a second laser light source and a light conversion element. The outputs from the first and second laser light sources are directed to the light conversion element, which generates wavelength-converted light output in response to excitation by laser light. The first and second laser light sources generate laser light of different wavelength having different absorption characteristics within the light conversion element, such that the range of depths within the light conversion element from which wavelength-converted light is generated is different. This difference in converted output can be used to create different optical effects so that beam steering or beam shaping can be performed.

19 Claims, 6 Drawing Sheets

(51) Int. Cl.

| | |
|---|---|
| ***F21S 41/40*** | (2018.01) |
| ***F21V 23/04*** | (2006.01) |
| ***F21S 41/16*** | (2018.01) |
| *F21Y 113/00* | (2016.01) |
| *F21Y 115/30* | (2016.01) |
| *F21Y 115/10* | (2016.01) |

(52) U.S. Cl.

CPC ..... *F21V 23/0457* (2013.01); *F21Y 2113/00* (2013.01); *F21Y 2115/10* (2016.08); *F21Y 2115/30* (2016.08)

(56) References Cited

U.S. PATENT DOCUMENTS

2012/0026721 A1* 2/2012 Kurt ..... G02B 6/0003 362/84
2012/0236536 A1 9/2012 Harada
2013/0208478 A1* 8/2013 Bowden ..... F21V 7/06 362/260
2013/0235601 A1 9/2013 Takahashi
2013/0294049 A1 11/2013 Finsterbusch et al.
2014/0218893 A1* 8/2014 Tamura ..... G02B 6/0008 362/84
2014/0321151 A1 10/2014 Sato et al.
2015/0002824 A1* 1/2015 Kasugai ..... G03B 21/204 353/31
2017/0219179 A1* 8/2017 Hirata ..... F21S 41/00

OTHER PUBLICATIONS

EPO as ISA, "International Search Report and Written Opinion" dated Feb. 10, 2016 from International Application No. PCT/EP2015/077235, filed Nov. 20, 2015, 9 pages.
European Search Report dated Jun. 15, 2015 from European Application No. 14195824.9 filed Dec. 2, 2014, 8 pages.
Chinese First Office Action dated Jun. 12, 2019, Chinese Patent Application No. 201580065790.4, 8 pages.

* cited by examiner

LASER BASED LIGHTING SYSTEM AND METHOD

CROSS-REFERENCE TO RELATED APPLICATIONS

The present application is a § 371 application of International Application No. PCT/EP2015/077235 filed on Nov. 20, 2015 and entitled "LASER BASED LIGHTING SYSTEM AND METHOD", which claims the benefit of European Patent Application No. 14195824.9 filed on Dec. 2, 2014. International Application No. PCT/EP2015/077235 and European Patent Application No. 14195824.9 are incorporated herein.

FIELD OF THE INVENTION

This invention relates to laser based lighting.

BACKGROUND OF THE INVENTION

Lasers are considered to be the light sources of the future for producing special effects. They are currently used for producing high intensity white light where laser beams are focused onto a light conversion element, such as a phosphor. Such light sources are interesting in applications such as stage lighting, projection and automotive front lighting systems.

There are many applications in which it is desirable to produce a light source where the beam shape can be adjusted. One example is automotive headlights, for example where different beam directions and shapes are required for main beam lighting and for dipped beam lighting. Directional control may also be used to provide beam steering when a driver is making a turn.

Laser based automotive lighting systems have been proposed. For example, U.S. Pat. No. 8,256,941 discloses a system in which a laser output can be optically switched to different phosphors, each forming part of a system which can give a different directional output.

SUMMARY OF THE INVENTION

The invention is defined by the claims.

According to an aspect of the invention, there is provided a laser lighting system, comprising:

a first laser light source;

a second laser light source;

a light conversion element; and an optical element for directing the outputs from first and second laser light sources to the light conversion element, which generates a wavelength-converted light output in response to excitation by laser light, wherein the first and second laser light sources generate laser light of different wavelength having different absorption characteristics within the light conversion element, such that the range of depths within the light conversion element from which wavelength-converted light is generated is different for excitation by the first laser light source output and the second laser light source output.

This system uses at least two lasers which emit two different wavelengths to pump a light convertor. The light conversion element converts the laser light, and comprises a luminescent material such as an inorganic phosphor. The luminescent material might also be an organic luminescent material(s) and/or quantum dot or rod based luminescent material (s).

The laser wavelengths and the absorption characteristics of the light converter are chosen such that the penetration depth of the wavelengths is different. In this way, the length of a light emitting region from the light conversion element can be adjusted. By providing different sizes of light output, different beam directions and/or sizes can then be produced.

The optical element may for example direct the outputs from the first and second laser light sources to the same location of the light conversion element. In this way, both laser light sources cause an output for the same initial depth part of the light conversion element, but one laser light source causes a light output from a deeper part as well. The optical element is for example a dichroic prism or a dichroic cross. In another embodiment a single dichroic mirror is used. The dichroic mirror reflects light from the first laser light source and transmits light from the second laser light source.

The system further comprises an optical output element which shapes the output light from the light conversion element as a function of the depth from which wavelength-converted light is generated.

By adjusting the ratio of the intensity of the two laser sources, the shape of the final exit beam can be adjusted.

In one example, the optical output element comprises a specular reflector spaced from the light conversion element. The shape of the reflector can be designed so that the overall output beam has a different shape and/or direction when it is emitted from a larger area of the light conversion element, compared to when it is emitted from a smaller area of the light conversion element. In another example, the optical output element comprises a slab of material providing total internal reflection.

The reflector may comprise a first portion associated with a first range of depths of the light conversion element, and a second portion having a different shape associated with an adjacent second range of depths of the light conversion element. Thus, differently shaped reflector portions can be used to create a desired output beam profile resulting from illumination by the two laser sources.

In another example, the optical output element comprises a diffractive, refractive, reflective, scattering or wavelength conversion element.

There are also various possible adaptations to the light conversion element.

In a most simple implementation it comprises a uniform slab of light conversion material, having a dimension in the direction of illumination which is greater than the absorption depth for at least one of the laser sources.

In another example, the light conversion element has a non-uniform absorption characteristic in the depth direction. This can be used to vary the intensity of the light output from different depths along the light conversion element.

In another example, the light conversion element has a first portion with the same absorption characteristic for the light output of the first and second laser light sources, and a second portion which has a different absorption characteristic for the light output of the first and second laser light sources.

In another example, the light conversion element has different portions with different light output characteristics.

These different approaches enable different optical output effects to be generated.

The light conversion element may comprise:

scattering particles;

a rough scattering outer surface.

The use of scattering in this way assists in the outcoupling of light from the light conversion element with reduced total internal reflection.

The light conversion element may have a cross sectional shape which varies along the length of the light conversion element. This can be used to adjust the light output characteristics at different positions (i.e. depths) along the light conversion element.

Each laser light source may comprise one or more laser diodes.

A controller is preferably used for controlling the first and second laser light source output intensities. The controller may operate one or other of the laser light sources as two different modes of operation, but there may also be a third mode of operation with both laser light sources operated. The output intensities of the two laser light sources may be independently controllable.

A sensor may also be provided for providing sensor information to the controller. This can be used to provide automated control of the output beam shape, for example automatic headlight operation, dimming or light steering.

The invention also provides an automobile front light comprising a laser lighting system as defined above.

Other examples in accordance with another aspect of the invention provide a method of generating laser lighting, comprising:

operating a first laser light source;

operating a second laser light source;

directing the outputs from first and second laser light sources to a light conversion element, thereby generating a wavelength-converted light output in response to excitation by laser light, wherein the first and second laser light sources generate laser light of different wavelength having different absorption characteristics within the light conversion element, wherein the method comprises generating wavelength-converted light from a range of depths within the light conversion element, which range of depths is different for light from the first laser light source output and light from the second laser light source output, and wherein the method further comprises shaping, by an optical output element, an output light from the light conversion element as a function of the depth from which the wavelength-converted light is generated.

The invention is not limited to the use of two laser light sources. There may be more than two laser light sources having different emission wavelengths.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a laser lighting system which has a first laser light source, a second laser light source and a light conversion element. The outputs from the first and second laser light sources are directed to the light conversion element, which generates wavelength-converted light output in response to excitation by laser light. The first and second laser light sources generate laser light of different wavelength having different absorption characteristics within the light conversion element, such that the range of depths within the light conversion element from which wavelength-converted light is generated is different. This difference in converted output can be used to create different optical effects so that beam steering or beam shaping can be performed.

Figure 1:
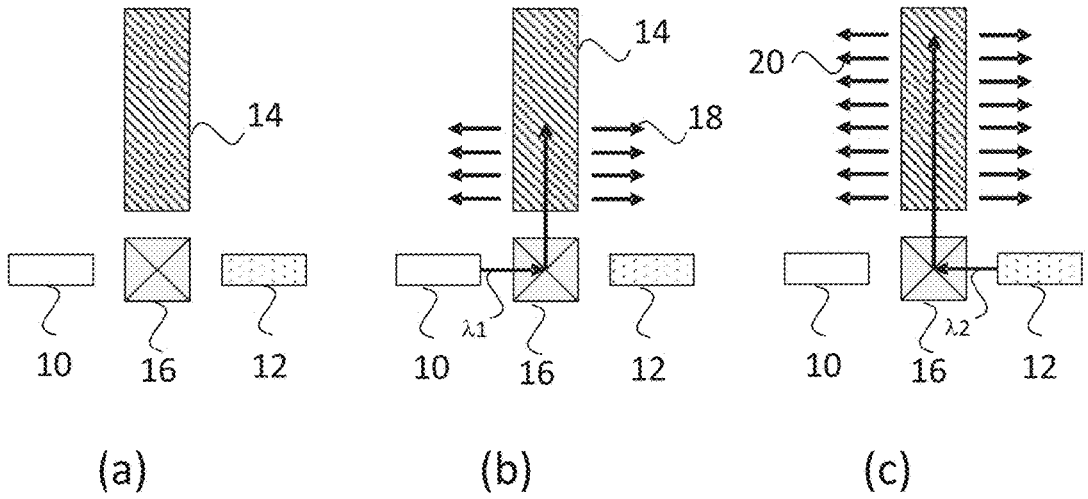
FIGS. 1(*a*), 1(*b*), and 1(*c*) show an example of part of a lighting system in accordance with the invention in simplified schematic form.

FIG. 1 is used to explain the approach of the invention in simplified schematic form.

FIG. 1(*a*) shows the basic components, of a first laser light source 10, a second laser light source 12 and a light conversion element 14. An optical element 16 directs the outputs from first and second laser light sources 10, 12 to the light conversion element 14. The optical element 16 may comprise a pair of dichroic mirrors which reflect the light of the laser wavelength to the light conversion element.

In another configuration a single dichroic element can be used. This dichroic element can be arranged to reflect the light of the first laser light source and transmit the light of the second laser light source. In this configuration the first laser light source is positioned at an angle different form zero with respect to the conversion element, while the second laser light source is positioned at an angle of zero degrees with respect to the light conversion element (not shown).

Of course, other configurations are possible for delivering the light output from two (or more) laser light sources to a shared light conversion element 14. The outputs from the first and second laser light sources can be directed to the same location (i.e. fully overlapping) of the light conversion element or to areas of the light conversion element which are at least partially overlapping.

The wavelength conversion element generates wavelength-converted light output in response to excitation by the laser light. The light conversion element for example comprises a luminescent material such as a phosphor.

The first and second laser light sources 10, 12 generate laser light of different wavelength, and with different absorption characteristics within the light conversion element. As a result, the range of depths within the light conversion element from which wavelength-converted light is generated is different when excited by the first laser light source output and the second laser light source output. Both laser light sources cause an output for the same initial depth part of the light conversion element, but one laser light source causes a light output from a deeper part as well.

FIG. 1(*b*) shows the wavelength converted light output 18 when the light conversion element 14 is excited by the output from the first laser light source 10. The laser light only penetrates partially into the depth of the light conversion element 14.

If the conversion element 14 is fully transparent and the surface is extremely smooth (polished) than part of the light will be emitted sideways and part of the light will be guided via total internal reflection through the conversion element. If the surface is rough or contains light out-coupling means, then most of the light is emitted to the sides. A roughened surface will result in a broad light distribution. However, a well-defined surface structure can be used to ensure that the output light is directed to a preferred range of output directions. Thus, the light output can be controlled to have a generally sideways direction as shown, although generally there will be light emission with some beam spread.

FIG. 1(*c*) shows the wavelength converted light output 20 when the light conversion element 14 is excited by the output from the second laser light source 12. The laser light penetrates fully into the depth of the light conversion element 14 giving a larger light output area.

In this way, the laser wavelengths and the absorption characteristics of the light converter are chosen such that the penetration depth of the wavelengths is different. In this way, the length of the light emitting region can be adjusted based on which of the laser light sources is used. By providing different sizes of light output, different beam directions and/or sizes can then be produced.

Figure 2:
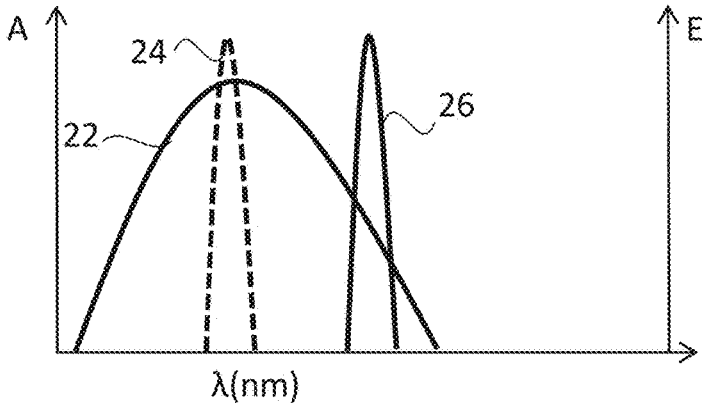
FIG. 2 shows the absorption characteristic of the light conversion element and the emission characteristics the laser light sources used in the system of FIG. 1.

FIG. 2 shows the absorption characteristic A of the light conversion element 14 (plot 22) and the emission characteristic E of the first laser light source (plot 24) and the emission characteristic of the second laser light source (plot 26).

The different light emission areas shown in FIG. 1 can be used to create different optical effects.

Figure 3:
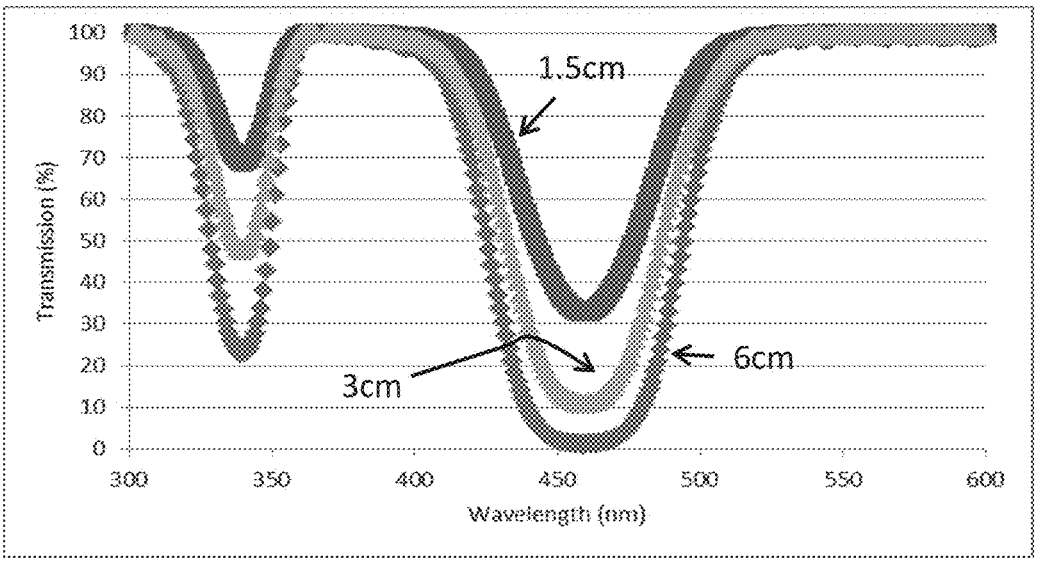
FIG. 3 shows a plot of transmission versus wavelength for a particular phosphor.

FIG. 3 shows a plot of transmission versus wavelength for a phosphor $(Y0.9+Gd0.1)_{(2.994)}Ce(0.00006)Al(5)O(12)$. Plots are shown for the transmission to three depths; 1.5 cm, 3 cm and 6 cm. As can be seen, at a wavelength of around 460 nm, there is full absorption by around 6 cm depth, so that light is emitted by the phosphor only at lower depths. There is already only 30% transmission after a depth of 1.5 cm so that 70% of the incident light is absorbed/converted by this depth. At the shorter wavelength of around 340 nm, there is much greater penetration into the depth of the converter layer so that there is a reduced intensity output at shallow depths and a more even intensity output over the full depth of the light conversion element.

Figure 4:
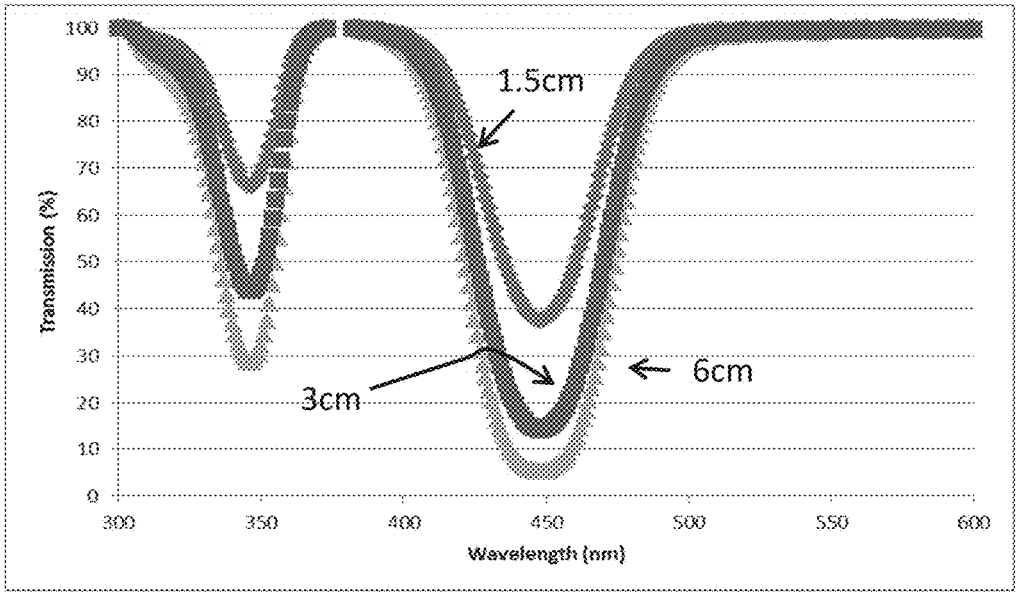
FIG. 4 shows a plot of transmission versus wavelength for a particular phosphor.

FIG. 4 shows a plot of transmission versus wavelength for a phosphor Lu(2.985)Ce(0.0005)Al(5)O(12). It shows a similar characteristic.

Figure 5:
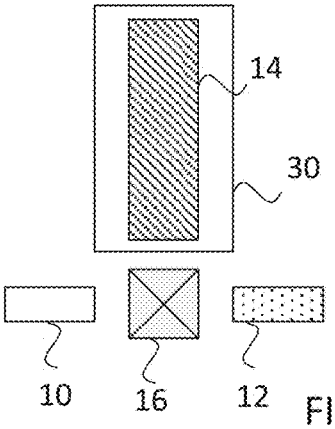
FIG. 5 shows in generic form the use of an optical output element.

FIG. 5 shows in generic form an optical output element 30. This is used to shape the output light from the light conversion element 14 as a function of the depth from which wavelength-converted light is generated. By adjusting the ratio of the intensity of the two laser sources, the shape of the final exit beam can then be adjusted. The optical output element is a diffractive, refractive, light scattering, light reflecting or light conversion element.

Figure 6:
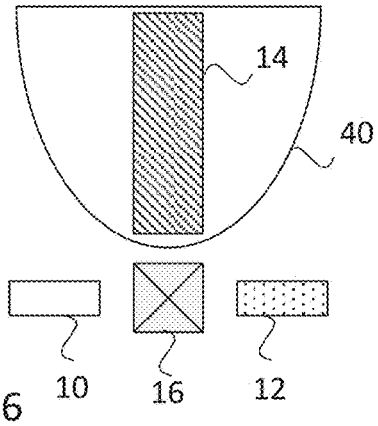
FIGS. 6 to 18 show different examples of lighting system in accordance with the invention.

FIG. 6 shows a first example, in which the optical output element comprises a specular reflector 40 spaced from the light conversion element 14. There may be other optical components in addition to the reflector. The shape of the reflector 40 can be designed so that the overall output beam has a different shape and/or direction when it is emitted from a larger area of the light conversion element, compared to when it is emitted from a smaller area of the light conversion element.

For laterally emitted light, a parabolic mirror can be used to create a narrow beam from light emitted near the base of the mirror (i.e. near the optical element 16), and to create a broader beam from light emitted near the opposite end of the mirror.

Figure 7:
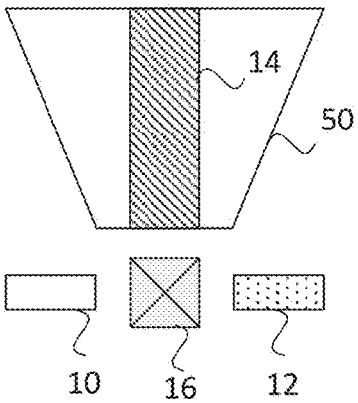

FIG. 7 shows a second example, in which the optical output element comprises a slab 50 of material providing total internal reflection at the outside boundary between the slab 50 and the surrounding air.

Figure 8:
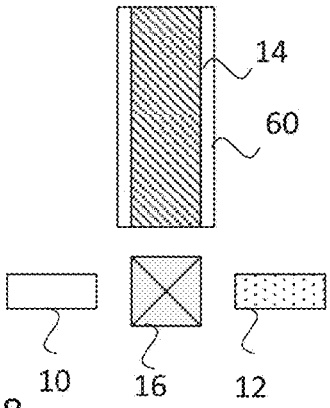

FIG. 8 shows a third example, in which the optical output element comprises a diffractive or refractive element 60.

The refractive design might for example be based on pyramid shape structures. With an air gap between the conversion element and the pyramid shape structures, the light can be collimated towards the reflector.

A diffraction grating can be used, which is an optical component with a periodic structure of e.g. dots or elongated features, which splits and diffracts light into several beams travelling in different directions.

Figure 9:
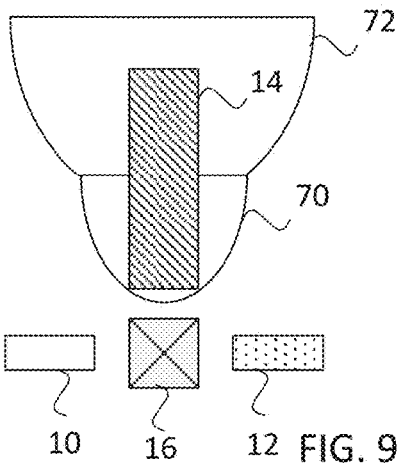

FIG. 9 shows a fourth example, which shows that when a reflector is used, it may comprise a first portion 70 associated with a first range of depths of the light conversion element 14, and a second portion 72 having a different shape associated with an adjacent second range of depths of the light conversion element 14. In this way, differently shaped reflector portions 70, 72 can be used to create a desired output beam profile resulting from illumination by the two laser sources. For example the first reflector portion 70 may be designed to generate a narrow beam from the excited light caused by the first laser light source (as shown in FIG. 1(*b*)) and the second reflector portion 72 may be designed to generate a broader beam from the excited light caused by the second laser light source (as shown in FIG. 1(*c*)).

In all examples above, the lighting system may be controlled with one laser light source on and the other off, to provide two distinct modes of operation. However, more modes may be provided by allowing both laser light sources to be turned on at the same time, and with controllable intensity. For example, the relative intensities can be controlled more freely. In this way, the intensity of the narrow beam part can be controlled relative to the intensity of the broad beam part.

The ability to provide broad and narrow beams is only one example. The optical system can be used to direct output light in different directions, or with different output beam shape and direction, for example for automotive front light control.

The design of the optical arrangement is used to create a desired optical output shape and direction from the system when illuminated by one or other of the laser light sources (and the shape and direction will be a combination of the two when both laser light sources are illuminated).

The design of the light conversion element may also be selected in dependence on the desired optical output.

In a most simple implementation, the light conversion element comprises a uniform slab of light conversion material, having a dimension in the direction of illumination which is greater than the absorption depth for at least one of the laser sources, so that only a part of the depth is excited by that laser light source.

Figure 10:
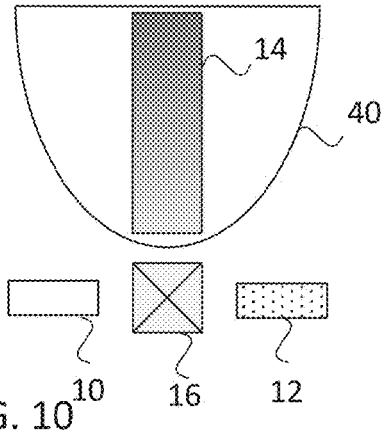

As shown schematically in FIG. 10, the light conversion element 14 may instead have a non-uniform absorption characteristic in the depth direction. This can be used to vary the intensity of the light output from different depths along the light conversion element.

Figure 11:
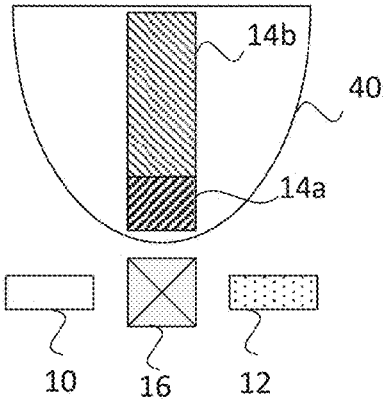

FIG. 11 shows another example, in which the light conversion element has a first portion 14*a* with the same absorption characteristic for the light output of the first and second laser light sources, and a second portion 14*b* which has a different absorption characteristic for the light output of the first and second laser light sources. In this way, the light output from the section 14*a* may be the same regardless of which laser light source is used, and only the light output from the second section 14*b* changes.

Figure 12:
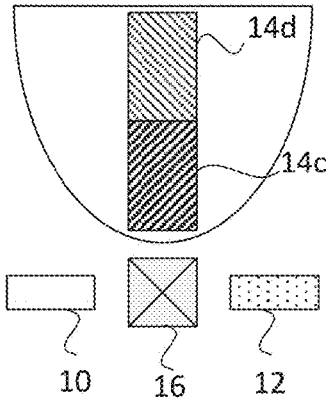

In another example shown in FIG. 12, the light conversion element has different portions 14*c*, 14*d* with different light output characteristics, by using different materials. This use of different materials may for example be used for color correction, so that both beam shapes have the same color temperature or color point, or so that the two beams have desired different color temperatures or color points.

These different approaches enable different optical output effects to be generated.

Figure 13:
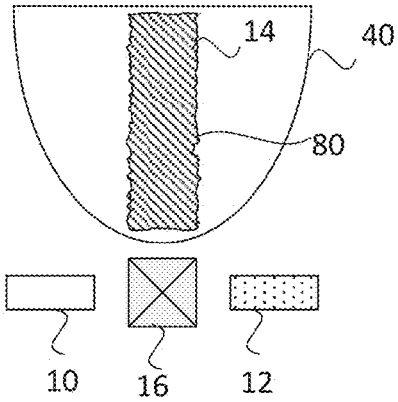

FIG. 13 shows that the light conversion element 14 may have a rough scattering outer surface 80. The use of scattering in this way assists in the out-coupling of light from the light conversion element with reduced total internal reflection.

Figure 14:
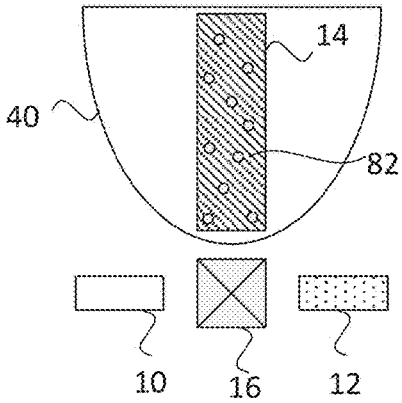

The same advantage can be achieved using scattering particles 82 as shown in FIG. 14. These particles are preferably applied on the outer side of the conversion element, but they may instead be internal particles.

Each laser light source may comprise one or more laser diodes.

Figure 15:
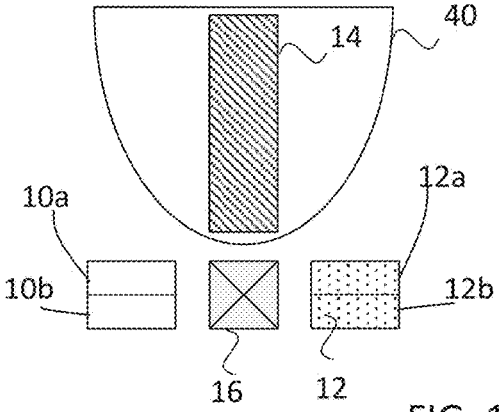

FIG. 15 shows the first laser light source as a stack of two laser diodes 10*a*, 10*b* and shows the second laser light source as a stack of two laser diodes 12*a*, 12*b*.

Figure 16:
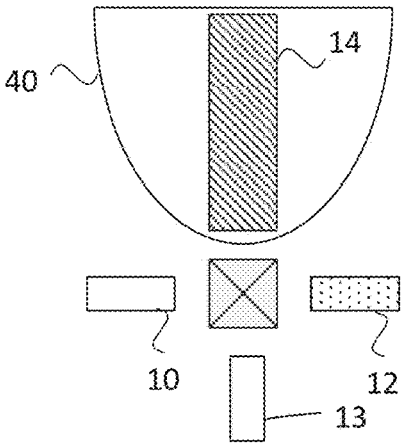

There may also be more than two types of laser diode. FIG. 16 shows an arrangement with three types of laser diode 10, 12, 13, which each excite the light conversion element to a different depth.

As mentioned above, the relative intensity of the two laser diodes is controlled to provide a change in the output beam shape and/or direction. The control may be as simple as selecting which laser diode to turn on, but it may instead involve selecting the intensity of each, so that one may be turned on to a desired intensity and the other turned off, or both may be turned on to desired respective intensities.

Figure 17:
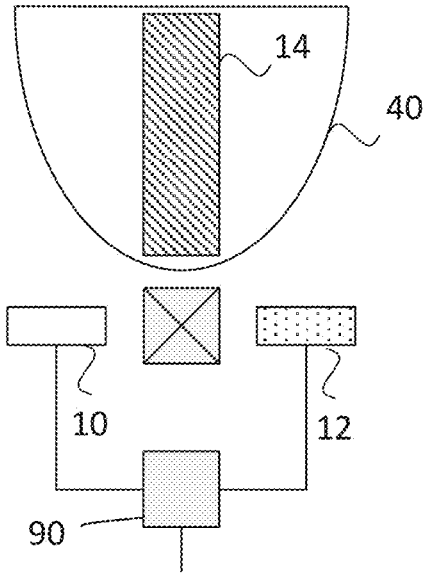

As shown in FIG. 17, a controller 90 is provided for controlling the first and second laser light source output intensities, to provide a lighting system. The output intensities of the two laser light sources is independently controllable by the controller 90.

Figure 18:
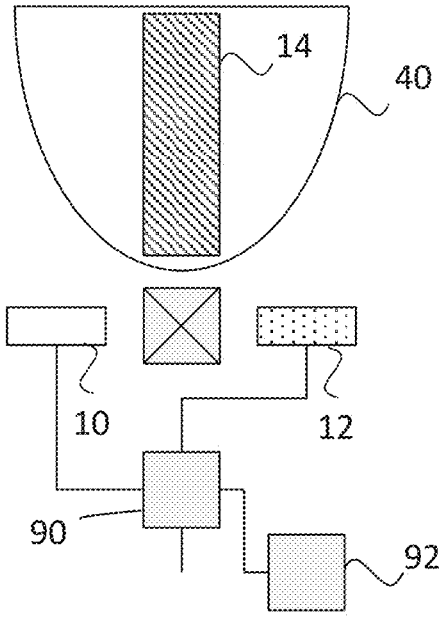

FIG. 18 shows the system of FIG. 17 supplemented with a sensor 92 for providing sensor information to the controller 90. This can be used to provide automated control of the output beam shape, for example automatic headlight operation, dimming or light steering.

As one example, the invention can be applied to an automotive front light system. There are however many other possible applications including office lighting systems, household application systems, shop lighting systems, home lighting systems, accent lighting systems, spot lighting systems, theatre lighting systems, fiber-optic systems, projection systems, self-lit display systems, pixelated display systems, segmented display systems, warning sign systems, healthcare/medical lighting application systems, indicator sign systems, decorative lighting systems, portable systems, other automotive applications, green house lighting systems, or horticulture lighting.

Figure 19:
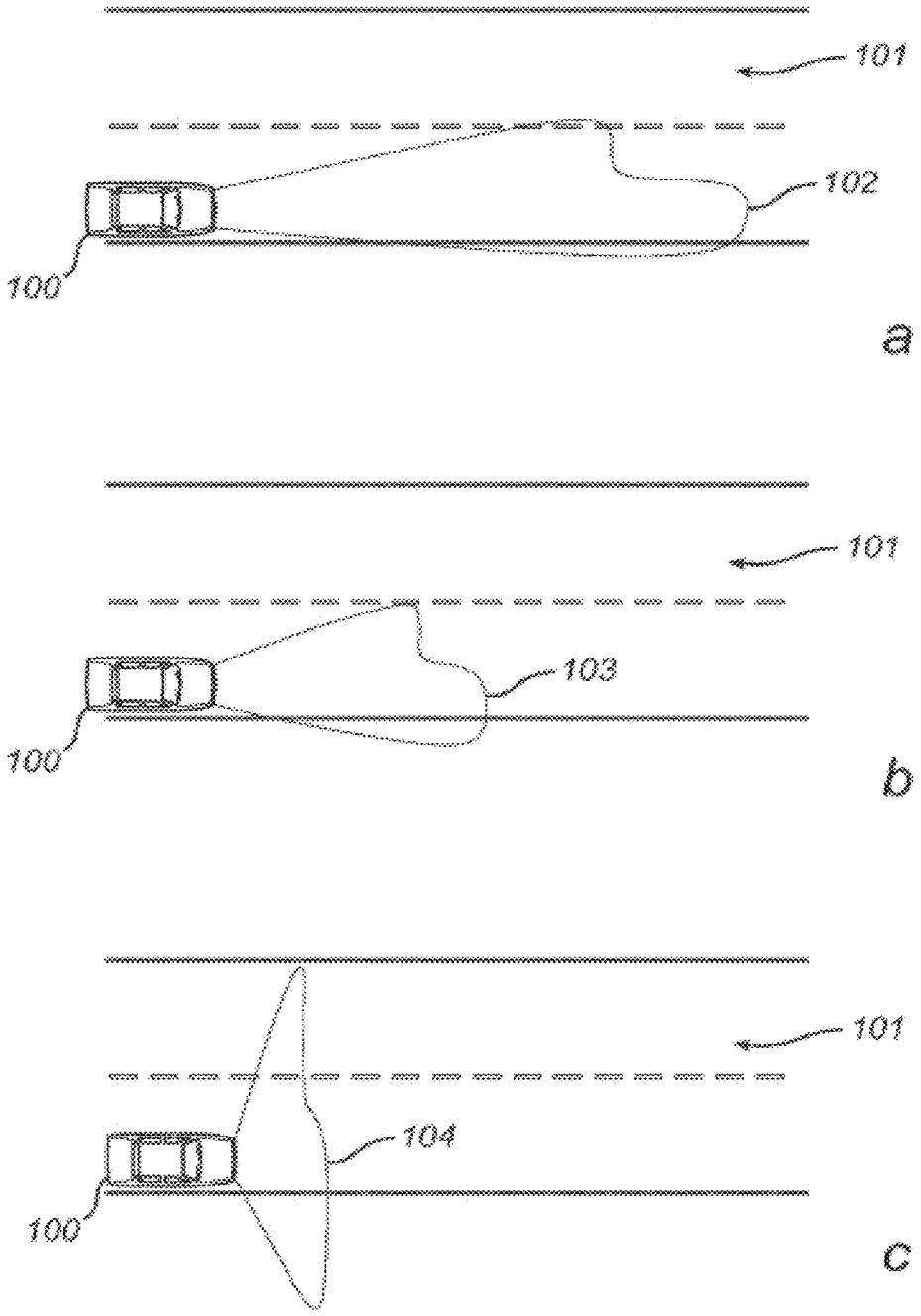
FIGS. 19*a*, 19*b*, and 19*c*show an automotive lighting application which can make use of the lighting system in accordance with examples of the invention.

By way of example, FIGS. 19*a* to 19*c* show a vehicle 100 illuminating a road 101. As shown in FIG. 19*a*, the headlight of the vehicle 100 is arranged to illuminate the road 101 in a highway light beam pattern 102 (full beam). The highway light beam pattern 102 is preferably used when traveling with the vehicle 100 along the road 101, for example a highway, at a relatively high speed. In this case, the optical axis of the light emitted from the headlight of the vehicle 100 is essentially parallel to the road 101.

However, when moving into a cross country environment, it is preferred to tilt the optical axis of the headlight of the vehicle 100 downwards towards the road 101, thereby obtaining a cross country light beam pattern 103 (dipped beam). The cross country light beam pattern 103 will prevent dazzling of oncoming vehicles and is preferably used when traveling at a medium speed.

In FIG. 19*c*, the light beam pattern 104 has been adapted for town lighting conditions. The optical axis of the headlight of the vehicle 100 has been tilted further downwards, and the emitted light has also been broadened, thereby obtaining a town light beam pattern. The town light beam pattern 104 is preferably used when traveling at a relatively low speed. The town light beam pattern 104 will increase the illumination of the shoulders of the road 101, increasing traffic safety in relation to, for example, pedestrians and cyclists moving on the side of the road 101.

All the different illumination patterns shown in FIGS. 19*a* to 19*c* can be accomplished with an adaptive front lighting system (AFS) comprising a light source and a lamp unit with luminescent concentrator based light sources according to the present invention.

The light conversion element is based on a luminescent material. The luminescent material may for example comprise an inorganic phosphor, organic phosphor or quantum dots/rods.

By way of example, an inorganic luminescent material may essentially be made of material selected from the group comprising:

$$(M<I>_{1-x-y}M<II>_xM<III>_y)_3(M<IV>_{1-z}M<V>_z)_5O_{12}$$

where M<I> is selected from the group comprising Y, Lu or mixtures thereof, M<II> is selected from the group comprising Gd, La, Yb or mixtures thereof, M<III> is selected from the group comprising Tb, Pr, Ce, Er, Nd, Eu or mixtures thereof, M<IV> is Al, M<V> is selected from the group comprising Ga, Sc or mixtures thereof, and 0<=x<=1, 0<=y<=0.1, 0<=z<=1; or $$(M<I>_{1-x-y}M<II>_xM<III>_y)_2O_3$$

where M<I> is selected from the group comprising Y, Lu or mixtures thereof, M<II> is selected from the group comprising Gd, La, Yb or mixtures thereof, M<III> is selected from the group comprising Tb, Pr, Ce, Er, Nd, Eu, Bi, Sb or mixtures thereof, and 0<=x<=1, 0<=y<=0.1; or $$(M<I>_{1-x-y}M<II>_xM<III>_y)S_{1-z}Se_z$$

where M<I> is selected from the group comprising Ca, Sr, Mg, Ba or mixtures thereof, M<II> is selected from the group comprising Ce, Eu, Mn, Tb, Sm, Pr, Sb, Sn or mixtures thereof, M<III> is selected from the group comprising K, Na, Li, Rb, Zn or mixtures thereof, and 0<=x<=0.01, 0<=y<=0.05, 0<=z<=1; or $$(M<I>_{1-x-y}M<II>_xM<III>_y)O$$

where M<I> is selected from the group comprising Ca, Sr, Mg, Ba or mixtures thereof, M<II> is selected from the group comprising Ce, Eu, Mn, Tb, Sm, Pr or mixtures thereof, M<III> is selected from the group comprising K, Na, Li, Rb, Zn or mixtures thereof, and 0<=x<=0.1, 0<=y<=0.1; or $$(M<I>_{2-x}M<II>_xM<III>_2)O_7$$

where M<I> is selected from the group comprising La, Y, Gd, Lu, Ba, Sr or mixtures thereof, M<II> is selected from the group comprising Eu, Tb, Pr, Ce, Nd, Sm, Tm or mixtures thereof, M<III> is selected from the group comprising Hf, Zr, Ti, Ta, Nb or mixtures thereof, and 0<=x<=1; or $$(M<I>_{1-x}M<II>_{x}M<III>_{1-y}M<IV>_{y})O_3$$

where M<I> is selected from the group comprising Ba, Sr, Ca, La, Y, Gd, Lu or mixtures thereof, M<II> is selected from the group comprising Eu, Tb, Pr, Ce, Nd, Sm, Tm or mixtures thereof, M<III> is selected from the group comprising Hf; Zr, Ti, Ta, Nb or mixtures thereof, and M<IV> is selected from the group comprising Al, Ga, Sc, Si or mixtures thereof, and 0<=x<=0.1, 0<=y<=0.1;

or mixtures thereof.

By way of example Ce doped Yttrium aluminum garnet may be used (YAG, $Y_3Al_5O_{12}$) or Lutetium-Aluminum-Granat (LuAG)

Examples of suitable organic wavelength converting materials are organic luminescent materials based on perylene derivatives, for example compounds sold under the name Lumogen® by BASF. Examples of suitable compounds that are commercially available include, but are not limited to, Lumogen® Red F305, Lumogen® Orange F240, Lumogen® Yellow F083, and Lumogen® F170, and combinations thereof.

Advantageously, an organic luminescent material may be transparent and non-scattering.

Quantum dots (or rods) are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with shell such as cadmium sulfide (CdS) and zinc sulfide (ZnS). Cadmium free quantum dots such as indium phosphide (InP), and copper indium sulfide (CuInS2) and/or silver indium sulfide (AgInS2) can also be used. Quantum dots show very narrow emission band and thus they show saturated colors. Furthermore the emission color can easily be tuned by adapting the size of the quantum dots. Any type of quantum dot known in the art may be used in the present invention. However, it may be preferred for reasons of environmental safety and concern to use cadmium-free quantum dots or at least quantum dots having a very low cadmium content.

The lighting system described above may be used in various applications, not only in automotive lighting. The system may be used as part of a lamp or a luminaire, or as part of a lighting system for use in digital projection, automotive lighting, stage lighting, shop lighting, home lighting, accent lighting, spot lighting, theatre lighting, fiber optic lighting, display systems, warning lighting systems, medical lighting applications, and decorative lighting applications.

In the example of FIGS. 10 to 18 above, the optical arrangement is shown as a simple reflector. However, in each of these embodiments, the other possible optical arrangements described above may instead be used.

In the examples above, the laser light from both sources is coupled to the same input face of the phosphor. However, they may instead couple to different faces of the phosphor, but still use a shared phosphor which generates light over a different area for the two laser light sources. The optical output element may use reflection, refraction or diffraction to create the desired optical output properties, and these may provide control of beam steering, beam shaping and/or beam spread.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A laser lighting system, comprising:

a first laser light source configured to generate a first laser light;

a second laser light source configured to generate a second laser light of a different wavelength than the first laser light;

a light conversion element comprising different absorption rates for the different wavelengths of the first and second laser lights within the light conversion element such that the light conversion element emits substantially sideways, in a direction transverse to a depth of the light conversion element, (1) a first wavelength-converted light output in response to excitation by the first laser light and (2) a second wavelength-converted light output in response to excitation by the second laser light, wherein:

the second laser light has a greater penetration depth into the light conversion element than the first laser light, such that the second wavelength-converted light output has a larger light output area from the light conversion element than the first wavelength-converted light output;

an optical element for directing the first and the second laser lights to the light conversion element; and an optical output element which shapes an output light from the light conversion element as a function of the depth from which the first and the second wavelength-converted light outputs are emitted sideways.

2. A system as claimed in claim 1, wherein the optical element directs the outputs from the first and second laser light sources to the same location of the light conversion element.

3. A system as claimed in claim 1, wherein the optical output element comprises a diffractive, refractive, reflective, scattering or wavelength conversion element.

4. A system as claimed in claim 3, wherein the optical output element comprises a diffraction grating that splits and diffracts light into several beams travelling in different directions.

5. A system as claimed in claim 1, wherein the optical output element comprises a specular reflector spaced from the light conversion element or a slab of material providing total internal reflection or a combination thereof.

6. A system as claimed in claim 5, wherein the specular reflector is a parabolic mirror that creates (1) a narrow beam from light emitted near a base of the parabolic mirror proximate to the optical element and (2) a broader beam from light emitted near a distal end of the parabolic mirror.

7. A system as claimed in claim 5, wherein the optical output element comprises the slab, which tapers from a distal end of the slab toward a base of the slab of material near the optical element.

8. A system as claimed in claim 1, wherein the optical output element comprises a reflector having (1) a first portion surrounding a first range of depths of the light conversion element and (2) a second portion having a different shape surrounding an adjacent second range of depths of the light conversion element.

9. A system as claimed in claim 1, wherein the light conversion element has a non-uniform absorption rate in the depth direction.

10. A system as claimed in claim 1, wherein the light conversion element has a first portion with the same absorption rate for the first laser light and the second laser light, and a second portion which has a different absorption rate for the first laser light and the second laser light.

11. A system as claimed in claim 1, wherein the light conversion element has different portions with different light output characteristics.

12. A system as claimed in claim 1, wherein the light conversion element comprises:

scattering particles; or a rough scattering outer surface.

13. A system as claimed in claim 1, wherein each laser light source comprises one or more laser diodes.

14. A system as claimed in claim 1, further comprising a controller for controlling the first and second laser light source output intensities.

15. A system as claimed in claim 14, further comprising a sensor providing sensor information to the controller.

16. An automobile front light comprising a laser lighting system as claimed in claim 1.

17. A system as claimed in claim 1, wherein the light conversion element comprises a uniform slab of light conversion material having a dimension in a direction of illumination that is greater than an absorption depth for at least one of the first laser light and the second laser light so that a part of the uniform slab is only excited by one of the first and the second laser light sources.

18. A system as claimed in claim 1, wherein the light conversion element has a length in a direction of illumination that is greater than its width.

19. A method of generating laser lighting, comprising:

operating a first laser light source to generate a first laser light;

operating a second laser light source to generate a second laser light; and directing the first and the second laser lights from the first and the second laser light sources to a light conversion element, thereby generating wavelength-converted light in response to excitation by laser light;

emitting substantially sideways from the light conversion element, in a direction transverse to a depth of the light conversion element, (1) a first wavelength-converted light output in response to excitation by the first laser light and (2) a second wavelength-converted light output in response to excitation by the second laser light, wherein:

the second laser light has a greater penetration depth into the light conversion element than the first laser light, such that the second wavelength-converted light output has a larger light output area from the light conversion element than the first wavelength-converted light output; and shaping, by an optical output element, an output light from the light conversion element as a function of the depth from which the wavelength-converted light is generated.

* * * * *